United States Patent [19]

Urani et al.

[11] 4,383,236

[45] May 10, 1983

[54] HEAT LIMITERS AND METHOD OF MANUFACTURE

[75] Inventors: Angelo Urani; Aldino J. Gaia, both of St. Louis, Mo.

[73] Assignee: McGraw-Edison Company, Rolling Meadows, Ill.

[21] Appl. No.: 334,534

[22] Filed: Dec. 28, 1981

[51] Int. Cl.[3] ..... H01H 37/76

[52] U.S. Cl. ..... 337/403; 337/142; 337/407

[58] Field of Search ..... 337/404, 407, 403, 168, 337/170, 142

[56] References Cited

U.S. PATENT DOCUMENTS 3,301,981 1/1967 Urani ..... 337/404

4,032,877 6/1977 McAlister ..... 337/404

*Primary Examiner*—Harold Broome

*Attorney, Agent, or Firm*—Charles W. MacKinnon; Jon C. Gealow; James Gabala

[57] ABSTRACT

A circuit interrupting device responsive to externally generated heat and method of manufacture of such device. The device includes a pair of spaced, coaxially aligned leads each entering a thermally conductive housing from an opposite end. The inserted ends of the coaxially aligned leads are bridged by a conductive member comprising the tail of a conical spring which surrounds one of the leads and is secured at a corresponding end of the housing. The circuit-completing spring tail is secured by fusible material to the inserted ends of each of the spaced-apart leads. In a normal, closed circuit condition, the spring is under tension. Upon heating, the fusible material softens, allowing the spring tail to break away from the inserted ends of the spaced-apart leads, the retracting force of the conical spring, pulling the spring tail from the other one of the leads to open the circuit.

12 Claims, 3 Drawing Figures

HEAT LIMITERS AND METHOD OF MANUFACTURE

BACKGROUND OF THE INVENTION

This invention relates generally to thermally responsive circuit interrupting devices and more particularly to thermally actuated switches having contractable solid elements biased for circuit-opening movement by a spring force and held in a conductive condition by masses of fusible material and method of manufacture of such thermally actuated switches.

Examples of devices which are intended to open electric circuits whenever the temperature surrounding the devices reaches a predetermined level are shown in U.S. Pat. Nos. 2,805,304; 2,913,555; 3,301,981; and 4,032,877. These devices include a housing designed to allow travel of a nonfusible circuit-completing conductor from its normal closed-circuit position to an open-circuit position. Such conductors are characteristically biased for circuit-opening movement by compressed helical springs which, when released, expand into cavities within the housings. Devices of the aforementioned type characteristically employ a separate circuit-completing conductor and spring biasing means.

Other devices which are intended to open electric circuits when the temperature in the immediate vicinity of the device reaches a predetermined level are disclosed in U.S. Pat. Nos. 3,924,218; 4,259,656; 4,276,531; and 4,276,532. These devices are characterized by the use of thermally sensitive pellets. The thermally sensitive pellets generally are of a nonconductive material, to avoid short circuiting the device upon melting. The pellets occupy a relatively large volume within the housing of the device to allow sufficient travel of the opening contacts, thereby to insure complete clearing.

While the prior art spring operated, thermally actuated switches operate satisfactorily for the most part, many are costly to manufacture and generate unnecessarily great amounts of internal heat, making their temperature ratings less precise.

SUMMARY OF THE INVENTION

Accordingly, it is an object of the present invention to provide a new and improved spring operated, circuit interrupting device connectable to open an electric circuit whenever the temperature of the device rises above a predetermined level in response to externally generated heat and which overcomes the drawbacks of the prior art devices described heretofore.

It is another object of this invention to provide a relatively uncomplicated, low-cost circuit interrupting device of the aforementioned type incorporating a minimum number of readily available inexpensive parts.

It is still another object of the present invention to provide a method for economically assembling a circuit interrupting device of the aforementioned type with minimal effort and skill.

The foregoing objects are accomplished in accordance with this invention, in one form thereof, by providing first and second spaced-apart, coaxially aligned electrical leads or terminals entering a housing. The leads pass through an electrically insulative bushing and washer respectively, positioned in openings at opposite ends of the housing which is preferably thermally conductive, but not necessarily electrically conductive. The leads are bridged by a non-fusing, conductive, elongated member comprising the elongated tail portion of a coil spring. The main coiled portion of the spring is planar volute in shape in its relaxed condition and assumes a conical shape when outstretched. This main portion of the spring biases the conductive tail portion for circuit-opening movement away from the first lead. The main spring portion, when outstretched, surrounds and is fusibly secured to the tip of the second lead by a mass of fusible material. The other end of the main spring portion is secured at a corresponding end of the housing. The elongated tail portion of the coil spring is secured to the first electrical lead by another mass of fusible material.

The main spring portion, which is wound about the second lead, is extended to its greatest length when the device is in a closed-circuit condition. As the temperature of the device rises above a predetermined temperature due to the presence of externally generated heat, the two masses of fusible material soften, allowing the extended main conical spring portion to resume its planar volute shape and in turn pull the integrally formed tail portion of the spring away from the first lead.

Because the main spring portion is normally extended and surrounds one electrical lead, the overall dimensions of the thermally-responsive circuit interrupting device is relatively small. Furthermore, since the main portion of the spring is shunted by the second lead, its impedance is not added to the current carrying portions of the interrupter device, and hence, the generation of internal heat is virtually avoided. As a result, the thermally-responsive circuit interrupting device provided by the present invention is compact and responds almost totally to externally-generated heat.

In manufacturing or assembling the device in accordance with the preferred method of this invention, two subassemblies are combined to form the completed device.

The first subassembly includes a thermally-conductive housing having an open end and a partially closed end. A bushing is inserted into the partially closed end of the housing. The second subassembly includes a coil spring and the first and second spaced apart coaxially aligned electrical leads which are joined together with fusing alloy at two locations along the elongated tail portion of the spring prior to joining the two subassemblies. The main coiled portion of the spring encircles the second lead. A washer is placed onto the second lead adjacent the spring to serve as a spacer and insulator between that lead and the housing.

Final assembly is accomplished by inserting the second subassembly, beginning with the first lead, into the open end of the first subassembly. The first lead is guided through the bushing at the partially closed end of the housing until the outermost coil or base of the main spring portion abuts an indentation in the housing formed near the open end. The indentation prevents further movement of the base of the spring and, therefore, as the first lead is pulled further through the bushing, the spring becomes outstretched into a conical shape, thus applying tension to the tail portion of the spring for subsequent operation. The first lead is crimped or otherwise attached to the bushing at the partially closed end of the housing.

DESCRIPTION OF THE PREFERRED EMBODIMENT

Figure 1:
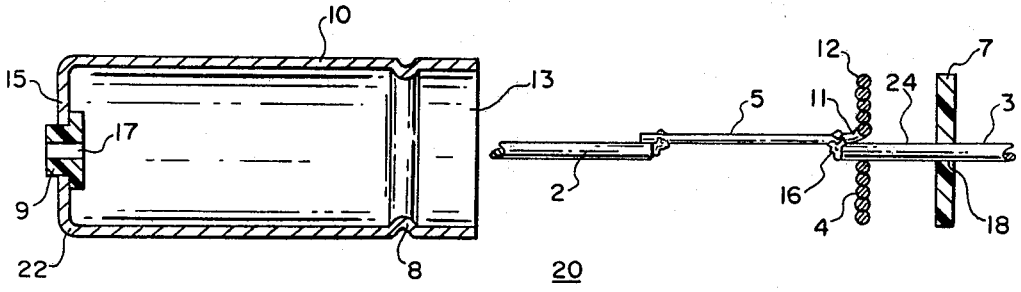
FIG. 1 is a side sectional view of an unassembled circuit interrupting device according to the invention, showing the components thereof.

Referring now to the drawings in greater detail, especially FIG. 1, a circuit interrupting device according to the invention, designated generally by the numeral 20, is constructed or assembled in accordance with the method of this invention by the combination of two subassemblies 22, 24, which are joined together to form a complete circuit interrupting device 20. The first subassembled 22 includes a housing 10 for containing the operating components of the circuit interrupting device after complete assembly. Housing 10 is preferably constructed of thermally conductive material to permit more accurate operation of the circuit interrupting device when mounted in direct thermal contact with a device being protected thereby. Housing 10 may be constructed of electrically conductive material, but need not be if it is desirable to electrically isolate the protection circuit from the device being protected. Housing 10 is cylindrically shaped, having one open end 13, and one partially closed end 15. An axially aligned hole 17 is defined at end 15 of housing 10 and a bushing 9 is received therein. A terminal or lead 2 is inserted through bushing 9. Bushing 9 is formed preferably of electrically insulating material for insulating terminal or lead 2 from housing 10. This is particularly important if housing 10 is electrically conductive. A circumferential indentation 8 is defined in housing 10 near end 13 thereof. Indentation 8 effectively reduces the cross-sectional dimension of housing 10 at that location.

Figure 2:
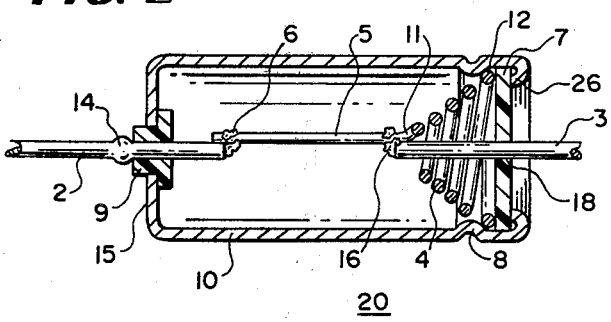
FIG. 2 is a side sectional view of an assembled circuit interrupting device, according to the invention, shown in a normally closed-circuit condition.
Figure 3:
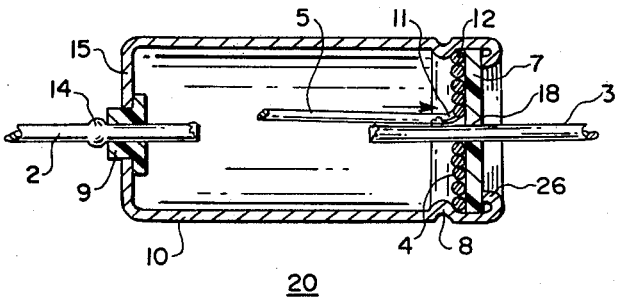
FIG. 3 is a side sectional view of the circuit interrupting device of FIG. 2 shown in an open-circuit condition.

The second subassembly 24, comprises the operating components of the circuit interrupting device as constructed according to the present invention. Referring again to FIG. 1, there is shown in a relaxed condition, a coil spring 4. Spring 4 as seen has a planar volute shape when relaxed, and when extended, as shown in FIG. 2, takes on a conical volute shape. Spring 4 includes a base 12 formed by the outermost turn thereof, and a tip 11 formed by the innermost turn thereof. An elongated conductor or tail portion 5 extends from tip 11 of spring 4. Conductor 5 is perpendicular to the plane of spring 4 in its relaxed state. Electrical connections between the circuit interrupting device and the protection circuit are made at terminals or leads 2 and 3. Lead 2 extends into housing 10 through bushing 9 to meet the free end of conductor 5, and is normally held in fixed contact therewith by a mass 6 of fusible conductive material, consisting of an alloy that melts at a predetermined temperature. Terminal or lead 3 extends into housing 10 from open end 13 thereof in coaxial alignment with lead 2. As mentioned heretofore, conductor 5 is preferably a tail portion or elongated end piece of spring 4 and is integrally formed therewith. Conductor 5 may, however, also take the form of a separate piece of conductive material secured to tip 11 of spring 4. Because it is desirable to exclude from the external electrical protection circuit as much of the relative high resistance of spring 4 as possible, lead 3, as shown in the preferred embodiment, extends into housing 10 sufficiently far to meet tip 11 of spring 4 and is normally held in fixed contact therewith by a second mass 16 of fusible conductive material. Lead 3 is inserted through the central aperature 18 of a washer 7 and through spring 4 and is axially aligned therewith. Washer 7 is preferably of electrically insulative material and is positioned directly adjacent base 12 of spring 4 after assembly.

As shown in FIG. 1, second subassembly 24 is assembled outside of housing 10 and thereafter is inserted into open end 13 of housing 10 by guiding terminal 2 through bushing 9 until base 12 of spring 4 abuts angular, circumferential indentation 8 located near the open end 13 of housing 10. With second subassembly 24 being supported within housing 10 but not yet tensioned, lead 2 is further drawn through bushing 9, thereby to stretch spring 4, causing it to take on a conical volute shape. Lead 2 is thereafter crimped at 14 or is otherwise held at bushing 9 in fixed, spaced relation to housing 10 as seen in FIG. 2.

Housing 10 is folded inwardly at edge 26 thereof to secure washer 7 in place in the housing and to close off end 13 thereof. Alternatively, washer 7 may be inserted into the open end 13 of housing 10 by placing the washer over lead 3 after insertion of second subassembly 24 into the housing. Washer 7 is then pressed against the outer edge of base 12 of spring 4 by the inward folding of edge 26 of housing 10 as described.

In operation, external heat generated by the device being protected by circuit interrupting device 20, raises the temperature of masses 6 and 16, respectively, of fusible conductive material, softening the masses sufficiently to allow the connections at either end of conductor 5 to be broken, thereby allowing spring 4 to compress and resume its relaxed planar volute configuration. Conductor 5, thereby becomes separated from lead 2, causing the normally completed circuit through the circuit interrupting device 20 to be opened.

While a particular embodiment of the invention has been shown and described, it should be understood that the invention is not limited thereto since modifications thereof may be made. It is therefore intended to cover by the present application any and all such modifications as fall within the true spirit and scope of the invention.

We claim:

1. A circuit interrupting device for opening an electric circuit at a predetermined temperature, including a combination:

first and second spaced apart terminals, each having a free end portion, said free end portions being predeterminedly spaced from each other, first and second masses of fusing conductive material, a coil spring having first and second portions, said first portion positioned in a fixed relationship with respect to said first and second spaced apart terminals, and said second portion secured to said second terminal near said free end portion of said second terminal by said second mass of fusing conductive material, thereby to maintain said spring in tension, and a conductive member extending from said second portion of said coil spring toward said free end portion of said first terminal, said first mass of fusing conductive material connecting said free end portion of said first terminal and said conductive member, thereby to complete a circuit between said first and second terminals, said masses of fusing conductive material being softenable at a predetermined temperature, sufficient to break said connections, thereby to permit said coil spring to relax, moving said conductive member away from said end portion of said first terminal to open the circuit between said first and second terminals.

2. The circuit interrupting device of claim 1, wherein said conductive member is formed integrally with said coil spring.

3. The circuit interrupting device of claim 1, wherein said coil spring has a conical volute shape when tensioned and a planar volute shape when relaxed.

4. The circuit interrupting device of claim 3, wherein said conductive member is formed as an integral part of said coil spring and extends perpendicularly to the plane of said spring when the latter is in a relaxed condition.

5. The circuit interrupting device of claims 1 or 4, wherein said terminals are aligned coaxially with said conductive member.

6. A circuit interrupting device, for opening an electric circuit at a predetermined temperature, including in combination:

a cylindrical housing having first and second ends, first and second spaced apart coaxially aligned terminals, each having a free end portion, said first terminal extending into said first end of said housing and said second terminal extending into said second end of said housing, a coil spring having a base portion and a tip portion, said base portion being secured adjacent said second, open end of said housing, a conductive member having first and second ends, said conductive member extending between said free end portions of said first and second terminals, first and second masses of fusing conductive material, said first end of said conductive member being normally connected to said first terminal by said first mass of fusing conductive material and said second end of said conductive member being normally connected to said second terminal by said second mass of fusing conductive material, said tip portion of said coil spring being attached to said second end of said conductive member thereby to outstretch and tension said coil spring, said first and second masses of fusing conductive material being softenable at a predetermined temperature, sufficiently to break said connections between said first end of said conductive member and said first terminal and between said second end of said conductive member and said second terminal, respectively, thereby permitting said coil spring to relax, moving said conductive member away from said first terminal to open the circuit between said first and second terminals.

7. The circuit interrupting device of claim 6, further including washer means defining a central aperture through which said second terminal extends and means for mounting said washer means at said second end of said housing, said washer mounting means including an angular indentation formed in said housing, spaced from said second end thereof and a folded housing portion, said washer means being held between said indentation and folded housing portion to prevent movement of said washer means in said housing.

8. The circuit interrupting device of claim 7 wherein said base portion of said spring is secured adjacent said second open end of said housing between said angular indentation and said washer means.

9. The circuit interrupting device of claim 6 wherein said first and second ends of said housing portion are open and wherein said device further includes a bushing, said bushing defining a central aperture, through which said first terminal extends, said bushing being mounted in said housing to substantially close off said first end.

10. The circuit interrupting device of claim 9 further including a disc shaped washer defining a central aperture through which said second terminal passes, said housing including an angular, generally circumferential indentation adjacent said second end and a folded portion, said washer being positioned between said indentation and said folded portion, thereby to secure said washer from movement with respect to said housing, said washer substantially closing off said second end of said housing.

11. The method of manufacturing a temperature sensitive circuit interrupting device, comprising the steps of:

providing a housing having first and second open ends;

said housing including a bushing defining a central aperture, said bushing being mounted in said first open end, and an indentation formed in said housing near said second open end thereby to reduce the width of said housing thereat;

providing a coil spring having a conical volute shape when in tension and a planar volute shape when relaxed with an elongated conductive member extending perpendicular to the plane of the spring in its relaxed shape;

providing first and second elongated terminals, each having a tip and a free end;

positioning said terminals in coaxially spaced relation with respective tips opposite one another;

providing first and second masses of fusing conductive material, softenable at a predetermined temperature;

connecting said elongated conductive member by means of said first fusible mass of conductive material at one end to the tip of said first elongated terminal and by means of said second fusible mass of conductive material at the other end to the tip of said second elongated terminal;

providing a washer having a predetermined aperture defined therein;

inserting the free end of said second elongated terminal into said aperture in said washer;

inserting the free end of said first elongated terminal into said cylindrical housing and through said aperture in said bushing;

urging said first terminal partially through said housing to cause the base of said spring to contact with indentation in said housing;

further urging said first terminal substantially through said aperture in said bushing sufficiently to place said spring under tension;

securing said first terminal with respect to said bushing;

sliding said washer into contacting engagement with said spring; and bending over said second end of said housing to secure said washer in engagement with said spring and to close off said second end of said housing.

12. The method of manufacturing a circuit interrupting device for opening an electrical circuit at a predetermined temperature, said method comprising the steps of:

providing a first subassembly including a housing having first and second ends, the first end including therein an insulative bushing defining an aperture therethrough, the opposite end of said housing being open;

providing a second subassembly including first and second co-axially aligned, spaced terminals, electrically connected to each other at first opposing ends by a conductive member, the first end of said conductive member being joined to a first end of said first terminal by means of a first mass of fusing conducting material, and the second end of said conductive member being joined to said first end of said second terminal by means of a second mass of fusing conductive material, and a coil spring having tip and base portions, said coil spring being conical volute shaped when outstretched and in tension and planar volute shaped when relaxed. The second end of said conductive member being joined to said tip of said coil spring, said conductive member extending perpendicular to the plane of said spring when said spring is relaxed;

inserting said second subassembly into the open end of said housing of said first subassembly to pass the free end of said first terminal into said aperture in said bushing at the opposite housing end;

securing said base of said coil spring at the second end of said housing while further inserting said second subassembly into said housing, thereby to outstretch said coil spring to its conical volute shape; and securing said first terminal with respect to said bushing to maintain said coil spring under tension.

* * * * *